US005461277A

United States Patent [19]

Van Gennip et al.

[11] Patent Number: 5,461,277

[45] Date of Patent: Oct. 24, 1995

[54] HIGH-PRESSURE GAS DISCHARGE LAMP HAVING A SEAL WITH A CYLINDRICAL CRACK ABOUT THE ELECTRODE ROD

[75] Inventors: Petrus M. G. Van Gennip; Mark J. L. M. Van Dommelen, both of Eindhoven, Netherlands

[73] Assignee: U.S. Philips Corporation, New York, N.Y.

[21] Appl. No.: 957,538

[22] Filed: Oct. 5, 1992

[30] Foreign Application Priority Data

Jul. 13, 1992 [EP] European Pat. Off. ..... 92202132

[51] Int. Cl.[6] ..... H01J 5/00

[52] U.S. Cl. ..... 313/331; 313/623

[58] Field of Search ..... 313/331, 623, 313/634, 318, 332

[56] References Cited

U.S. PATENT DOCUMENTS

| | | | |
|---|---|---|---|
| 3,868,528 | 2/1975 | Lake et al. . | |
| 4,282,395 | 8/1981 | Hagemann | 313/331 |
| 4,594,529 | 6/1986 | de Vrijer . | |
| 4,749,905 | 6/1988 | Mori et al. | 313/331 |
| 5,077,505 | 12/1991 | Ekkelboom et al. | 313/318 |

FOREIGN PATENT DOCUMENTS

| | | |
|---|---|---|
| 0206598 | 6/1986 | European Pat. Off. . |
| 0330268 | 8/1989 | European Pat. Off. . |
| 0410511 | 1/1991 | European Pat. Off. . |

*Primary Examiner*—Sandra L. O'Shea
*Assistant Examiner*—Vip Patel
*Attorney, Agent, or Firm*—Brian J. Wieghaus

[57] ABSTRACT

A high pressure discharge lamp includes a sealed lamp vessel (1) having a quartz glass wall (2) enclosing a discharge space (3). Metal foils (4) are embedded in the wall, connected to electrode rods (6), and have a circumferential coating (7) of quartz glass at least adjacent the metal foil. The coating has a firm adherence to the rod. It may comprise in its boundary (7') adjoining the rod/coating interface an addition, e.g. selected from a group comprising thorium, yttrium, hafnium. Alternatively, rhenium may be present at the surface of the rod, giving an interlocking configuration of the rod and its coating. Due to a strong adherence of the quartz glass to the rod upon completing a seal, and due to large differences in expansion coefficients, the coating is torn off from the wall so as to be mechanically loose from the wall. The coating prevents premature failure of the lamp caused by leakage.

18 Claims, 2 Drawing Sheets

HIGH-PRESSURE GAS DISCHARGE LAMP HAVING A SEAL WITH A CYLINDRICAL CRACK ABOUT THE ELECTRODE ROD

BACKGROUND OF THE INVENTION

The invention relates to a high-pressure gas discharge lamp comprising:

a lamp vessel which is closed in a vacuum-tight manner and which has a quartz glass wall enclosing a discharge space;

metal foils embedded in the wall of the lamp vessel and each connected to a respective external current conductor;

tungsten electrode rods which may have an additive, are connected each to a respective one of said metal foils, and project from the wall of the lamp vessel into the discharge space; and an ionizable filling in the discharge space.

Such a high-pressure gas discharge lamp is known from U.S. Pat. No. 4,594,529. The known lamp is suitable for use as a vehicle headlamp and has electrode rods which may or may not have an enveloping winding at their ends and which may be made of, for example, thoriated tungsten.

High requirements are imposed on the speed with which the lamp, after it has been energized, provides a major fraction of the luminous flux which it provides during stable operation. It is also necessary for the lamp to be capable of being ignited while it is still hot owing to a previous operating period. The lamp is ignited at a voltage of several kV and several kHz in order to comply with these requirements.

It was found that the known lamp has only a short life when it is frequently switched on and switched off again after a short operating period. The lamp vessel is then found to have become leaky, owing to which filling components have escaped and the lamp no longer ignites, or the lamp vessel is then cracked.

In the manufacture of the known lamp, a seal is made in which one or several said metal foils are enclosed in the wall. During this, the quartz glass is softened at the area where this seal is to be created in the presence of the metal foil, the external current conductor and the electrode rod. After forming the seal the glass is allowed to cool down. Owing to its comparatively high coefficient of linear thermal expansion (approximately $45 * 10^{-7}K^{-1}$), the electrode rod then contracts more strongly than does the quartz glass, glass having an $SiO_2$ content of at least 98% by weight (approximately $6\times10^{-7}K^{-1}$) in which it is embedded. This creates a capillary space around the electrode rod. No such capillary space is created around the metal foil, often a molybdenum foil, because of the foil shape.

When the known lamp is ignited, the temperature of the electrode rods rises steeply owing to the high current flowing through them and owing to heat transfer from the discharge. The quartz glass does not instantaneously follow this temperature rise. Owing to their higher temperature and their higher coefficient of expansion, the rods will come into contact with the quartz glass and exert pressure on it. This pressure creates microcracks, in the quartz glass, which microcracks may increase in number and size during subsequent ignition periods and lead to lamp leaks.

A possibility of avoiding these effects consists in the creation of a comparatively wide space around the electrode rods, so that it is prevented that the glass of the wall touches the rods during the manufacture of the seal. This possibility, however, is not always feasible in practice, because a space of comparatively low temperature arises thereby during operation, in which space filling components of low volatility may accumulate and thus may no longer take part in the discharge. Lamps having such a comparatively wide, but restricted space around the electrode rods are disclosed in EP 0 206 598-B1.

U.S. Pat. No. 3,868,528-A discloses a metal halide lamp in which current supply conductors for a main and for an auxiliary electrode are enclosed in a seal of the lamp vessel next to one another. Under the influence of their opposite potentials and the metal halide, devitrification of the seal may occur in this lamp. To prevent this, the spaces surrounding the electrode rods in this lamp are filled with an alkaline earth-aluminosilicate glass with a comparatively low melting point and with a linear thermal coefficient of expansion which is close to that of tungsten. A disadvantage of this is that the electrode rod must be kept above the metal foil while the seal is being made in order to allow the silicate glass to flow into the space around the rod and to keep it there. It is not possible in this position to cool an ionizable filling in the lamp vessel sufficiently. This filling must be provided in a subsequent step through an exhaust tube, after which the exhaust tube is sealed. An exhaust tube, however, interferes with the beam paths of generated light. Accordingly, the resulting lamp is not suitable for reflector applications where precise beam patterns are requested, such as in automotive lamps.

The invention has for its object to provide a high-pressure gas discharge lamp of the kind mentioned in the opening paragraph which is of a simple construction and in which premature failure is counteracted.

SUMMARY OF THE INVENTION

According to the invention, this object is achieved in that in the wall the electrode rods have a circumferential coating of quartz glass, at least adjacent the relevant metal foil, which coating is mechanically unconnected with the quartz glass of the wall.

The invention is based on the recognition that the electrode rods must be given a greater mass without substantially changing their electrical characteristics and the characteristics of the discharge thereby. The quartz glass coating of the electrode rods increases the mass of the rods and thus their heat capacity, the energy required for one degree of temperature rise, and also increases their diameter and thus their heat conductance. However, the glass coating does not increase the electrical conductance of the electrode rods. The increased mass decelerates the temperature rise of the rods during lamp ignition, so that the surrounding quartz glass of the wall is given an opportunity of assuming a higher temperature and expanding owing to the permanent contact with the embedded metal foil, partly also as a result of the heat generated in this foil by the current passage.

The high-pressure gas discharge lamp according to the invention is very easy to manufacture.

Manufacture may start, for example, with electrode rods which have an additive, e.g. $ThO_2$, at least at their surfaces. The rods, fastened to the metal foil with the external current conductor, are enclosed in the wall of the lamp vessel in that the glass of the lamp vessel under manufacture is locally heated and brought into contact with said metal parts. Contraction takes place upon cooling-down. Strain is created by this in the glass, which causes the glass to crack, forming the circumferential quartz glass coating of the rods the circumferential coating is mechanically unconnected with the glass of the wall owing to the said crack.

The crack follows a path which has such a shape that strain at the surface of the coating is at a minimum: the crack starts at an acute angle α to the rod in the location where the rod loses its contact with the wall adjacent the discharge space, runs on in a substantially cylindrical shape towards the metal foil and ends there at an acute angle to the rod. The vacuum-tight seal of the lamp vessel is present, as usual, in a zone between the ends of the metal foil. If the electrode rod should continue to outside the lamp vessel, and accordingly no embedded metal foil were connected to it, the lamp vessel would obviously be leaky from the start.

It was found that the coatings of individual lamps of one kind may have varying lengths because the rod loses its contact with the wall in locations which vary from lamp to lamp when the seal is made. This may be due to small variations in the temperature of the quartz glass during making of the seal. When the seal is being made, the wall portions facing towards the discharge space are heated as little as possible so as to avoid deformation. Accordingly, there is a strong temperature gradient during making of the seal, the location of which may be subject to minor variations. If during sealing a location which will be situated in the seal in an individual lamp has a high temperature which is lower than would otherwise be the case, the quartz glass in that location is comparatively viscous and no adhesion to the rod takes place in that location. The glass of that location then has no contact with the rod upon cooling down. It has also been found, however, that the object of the invention is achieved in spite of variations in the length of the coating, i.e. of the longitudinal portion of the electrode rod which has the coating. In a zone adjoining the metal foil adhering to the quartz glass for achieving a vacuum-tight seal, in fact, this coating is achieved at a result of the high temperature and the close contact between the quartz glass and the current lead-through in that spot during sealing, or under the pressure exerted by the pinching blocks on the electrode rod during making of a pinched seal.

The quartz glass of the coating has a strong adhesion to the electrode rod owing to the additive present at least at the surface of the rod which has penetrated into the layer of the coating which adjoins the interface between the electrode rod and the coating.

In addition to the durability of the lamp and its ease of manufacture, the lamp has the advantage that the passage which has arisen owing to the crack has only a very small width, smaller than the width of the said capillary space.

EP 0 330 268-A1 discloses electrical lamps which are closed in a vacuum-tight manner and in which a tungsten wire does run directly from outside the lamp vessel through its wall into the interior. This wire accordingly has a coating of quartz glass to which the wall, however, is sealed between the coating's ends, so that the coating projects from the wall both inside and outside the lamp vessel. The coating is provided separately and ends at both sides at an acute angle. It is essential that the coating comprises an additive, such as thorium, in a layer which adjoins the metal/glass interface. It may nevertheless be advantageous, as it is in the lamp according to the present invention, to use a conventional current lead-through comprising a foil portion, because the industrial use thereof is very familiar.

If the additive is dispersed throughout the electrode rod, according to the cited EP Application, such as in the case of a rod of thoriated tungsten, the surface of the rod must be provided with this additive in order to achieve that the quartz glass will adhere to the rod. For this purpose, the rod may be oxidized first and the tungsten oxide may be removed by evaporation, so that a skin is removed from the rod. The additive present in this skin, however, remains behind at the surface.

Alternatively, additives may be provided on the surface of the rod, for example, in the form of a suspension, according to the cited EP Application. When the quartz glass coating is provided, the additive then penetrates the coating in a layer adjoining the metal/glass interface, thus achieving adhesion to the rod.

According to the cited EP Application, additives which may be used are, for example, thorium, hafnium, chromium, aluminium, titanium, tantalum, magnesium, calcium, strontium, barium, zirconium, lanthanum, scandium, lanthanides, niobium, boron, yttrium, as elements or in the form of oxides or salts. The presence of the added element in the glass of the coating at the metal/coating interface can be demonstrated in a "Scanning Electron Microscope" by means of "Energy Dispersive Analysis by X-rays" or "Wavelength Energy Dispersive Analysis by X-rays".

Alternatively, the process may start with electrode rods which contain rhenium at least at their surfaces. Rhenium may have been provided, for example, as a suspension or as a suspension of its oxide or of a salt. When an oxide or salt is heated, for example to 2200° C., the compound is dissociated and rhenium remains behind. Alternatively, manufacture may start with tungsten/rhenium wire, for example, comprising one to several % by weight of rhenium, and rhenium may be brought to the surface in that the wire is oxidized and tungsten oxide is evaporated.

It is known from EP 0 410 511-A1 that tungsten wire with rhenium at its surface has a strong adhesion to a quartz glass coating, with a mechanically interlocking configuration, and that the coated wire can be directly sealed into a quartz glass lamp vessel between the ends of its coating. No rhenium could be demonstrated in the quartz glass immediately adjoining the metal/glass interface.

The coating of the electrode rods may alternatively be provided in a separate step preceding the manufacture of the lamp, for example, by means of a quartz glass tube.

The high-pressure gas discharge lamp according to the invention may be used, for example, as a vehicle headlamp, or in an optical system of a different kind. For this purpose, the lamp may be fixed in a lamp cap, and may or may not be surrounded by an outer envelope. A lamp cap may or may not be integrated with a reflector.

The metal foils may be embedded next to one another in one region of the wall, or they may be embedded in regions situated at a distance from one another, for example, opposite one another.

BRIEF DESCRIPTION OF THE DRAWINGS

Embodiments of the high-pressure gas discharge lamp according to the invention are shown in the drawing, in which.

DESCRIPTION OF THE PREFERRED EMBODIMENTS

Figure 1:
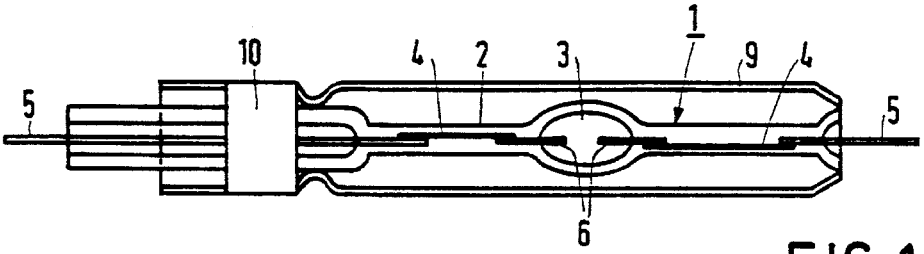
FIG. 1 shows a lamp in side elevation.

The high-pressure gas discharge lamp in the drawing has a lamp vessel 1 which is closed in a vacuumtight manner and has a quartz glass wall 2 enclosing a discharge space 3. Metal foils 4 connected to respective external current conductors 5 are embedded in the lamp vessel wall. Tungsten electrode rods 6 are each connected to a respective one of said metal foils and project from the lamp vessel wall into the discharge space. In the Figure, the rods 6 are made of Mo with 0.5

$Y_2O_3$ by weight. As usual the metal foils have feathered edges. An ionizable filling is present in the discharge space.

In the wall 2 at least near the relevant metal foil, the electrode rods 6 each have a circumferential coating 7 of quartz glass, which is mechanically unconnected with the glass of the wall 2.

The electrode rods 6 comprise an additive which is present at least in a layer of the coating 7 adjoining the interface of electrode rod 6 and the coating.

The additive comprises an dement chosen from the group consisting of thorium, hafnium, chromium, aluminium, titanium, tantalum, magnesium, calcium, strontium, barium, zirconium, lanthanum, scandium, lanthanides, niobium, boron, and yttrium.

Figure 2:
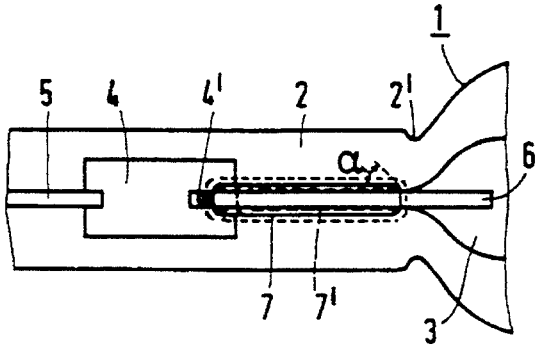
FIG. 2 shows a detail of FIG. 1 on an enlarged scale.

The electrode rods 6 of FIGS. 1 and 2 comprise a small quantity of tungsten crystal growth regulating means, such as 0.01% by weight in total of K, Al, and Si, and as an additive 1.5% $ThO_2$ by weight distributed through said rods. The tungsten crystals have an average size of $3 * 3 * 10\ \mu m^3$. A skin was removed from the rods 6 in that the latter were oxidized and the formed oxides were removed, whereby $ThO_2$ was brought to the surface. The rods 6, are connected to the metal foils 4, which are connected to the external conductors 5. The rods 6 are made of Mo in the present embodiment, and were partly enclosed in the lamp vessel wall in that the quartz glass was fused to them, or in that the quartz glass was pinched so as to make a pinched seal.

In the Figure, the lamp vessel is surrounded by an outer envelope 9 and coupled thereto. The lamp may be gripped by a lamp cap at a metal clamping sleeve 10.

The lamp has a filling of mercury, sodium iodide and scandium iodide, and xenon, for example, xenon at a pressure of 7 bar at room temperature, and consumes a power of 35 W during operation at rated voltage.

Figure 5:
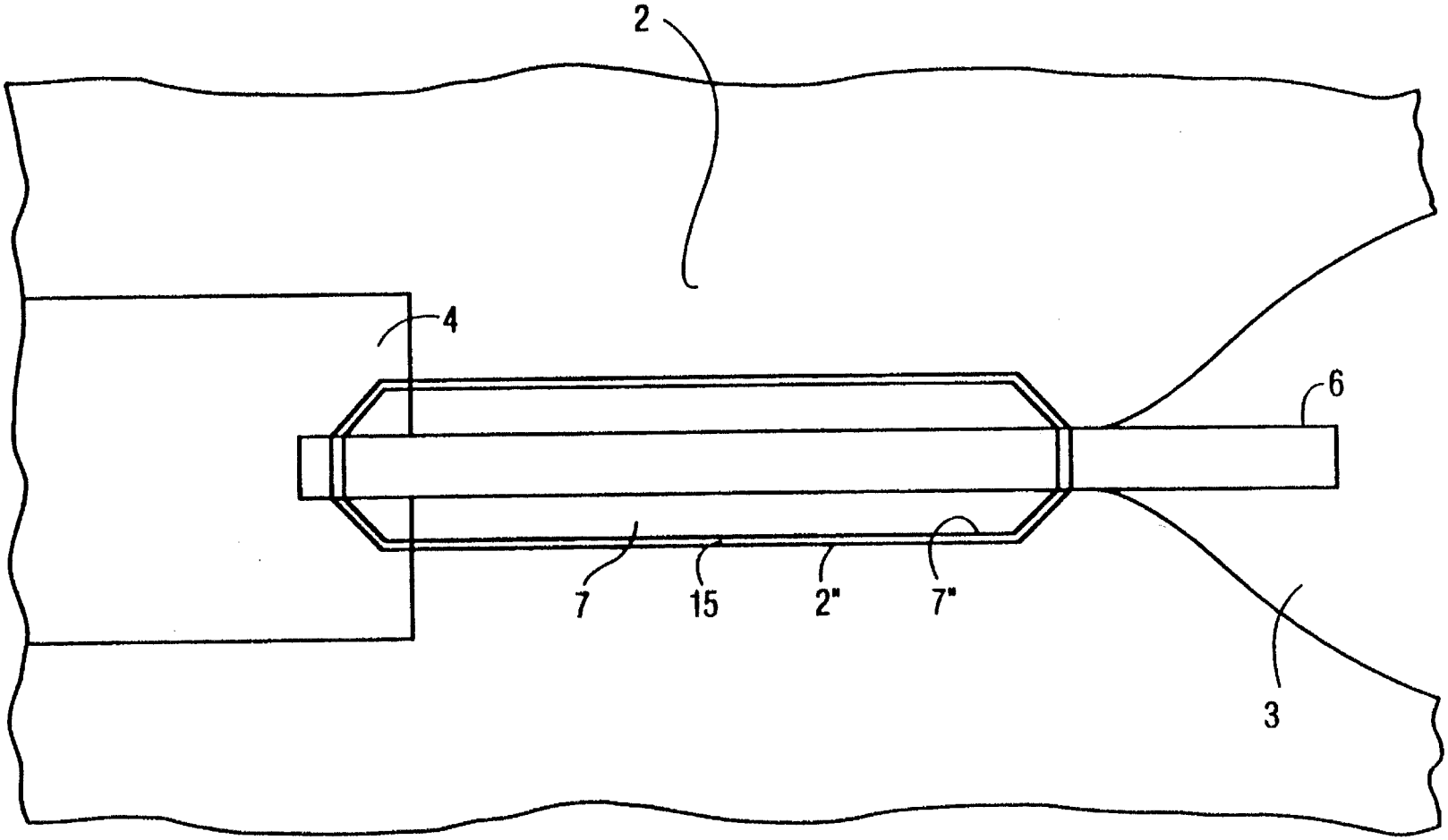
FIG. 5 is an enlarged view of the seal area showing the crack in greater detail.

It is visible in FIG. 2 that the electrode rod 6 has a coating 7 inside the wall 2 of the lamp vessel 1 at least adjacent to the metal foil 4. The coating is fully circumferential and made of quartz glass, the glass of the lamp vessel 1. The coating is substantially cylindrical in shape with tapering ends near the foil 4 and at the area where the rod loses its contact with the glass. As a result, the coating has an acute edge angle $\alpha$. The broken line 7' indicates that layer of the coating 7 which adjoins the electrode rod/coating interface. It is noted that the lamp vessel wall at the area indicated with 2' is not deformed during making of the seal because the lamp vessel under manufacture had already been given its final shape in that location before. No close circumferential contact between the rod and the glass was effected in this location. In a zone of the electrode rod having a length of at least one third the distance between the foil and the location referenced 2' and provided with a ridge, the temperature of the quartz glass is always sufficiently high for achieving close contact, and thus adhesion, during lamp manufacture. FIG. 5 is an enlarged detail of the coating 7/wall 2 interface of FIG. 2. The generally cylindrical glass coating 7 is fixed to rod 6 and has an outer surface 7" separated from the surface 2" of the wall 2. The surfaces 2", 7" define the generally cylindrical crack 15 by which the coating 7 is mechanically disconnected from the wall 2.

In the embodiment shown, the electrode rod has a thickness of 250 μm and the coating has a layer thickness of approximately 40 μm. It can be seen that the coating 7 and the crack surrounding it end at the weld 4' between the rod and the foil, or at the foil. The seal 2 is vacuumtight in a zone between the external current conductor and the electrode rod 4.

Figure 3:
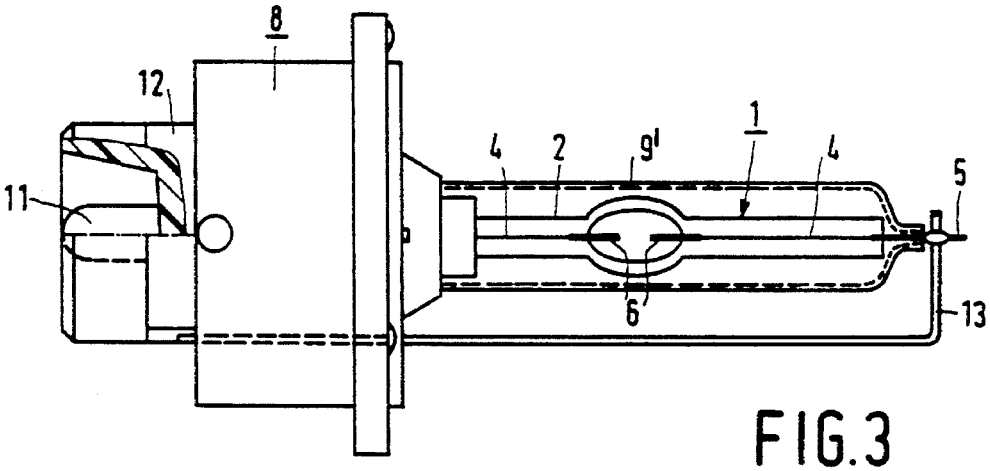
FIGS. 3 and 4 show the lamp of FIG. 1 with a lamp cap in side elevation.

In FIG. 3, the lamp vessel 1 is enclosed in a different outer envelope 9' and coupled thereto. The lamp vessel is fixed in a lamp cap 8 of the bayonet type, provided with a central pin contact 11 and a ring contact 12 which are connected to respective electrode rods 6, the ring contact via a connection conductor 13. The electrode rods have $Y_2O_3$ as the additive, both in their bulk, 3% by weight, and in the glass of their coatings.

Figure 4:
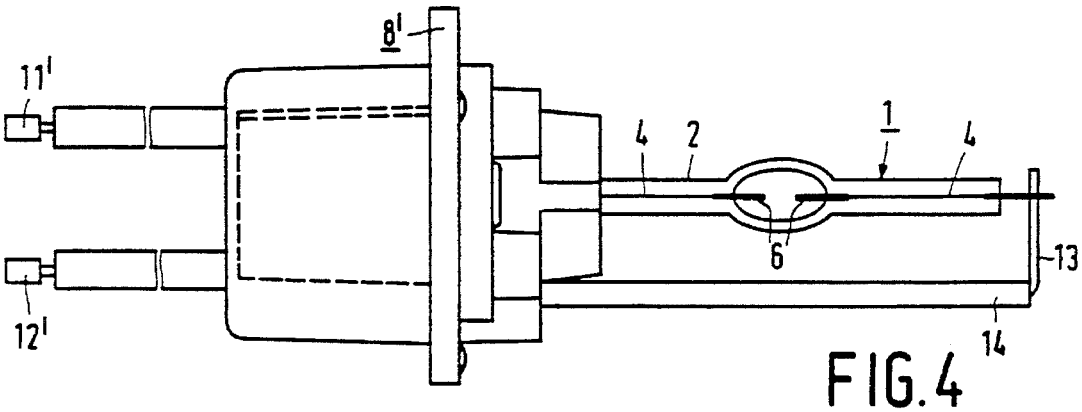

In FIG. 4, the lamp vessel 1 is enclosed in a different lamp cap 8' which has contacts 11' and 12' at cables issuing to the exterior. The electrode rods 6 comprise $HfO_2$ as the additive in a layer of the coating which adjoins the electrode rod/coating interface. A ceramic insulator 14 is present around the connection conductor 13.

In a modified version, the lamp of FIG. 4 has electrode rods of tungsten with 1% rhenium by weight distributed therein. Rhenium is also present at the surface, whereby a strong adhesion between the quartz glass coating and the electrode rods is obtained owing to the interlocking surface structures of the rods and their coatings.

We claim:

1. A high-pressure gas discharge lamp comprising a lamp vessel closed in a vacuumtight manner and having a quartz glass wall enclosing a discharge space;

metal foils and external current conductors embedded in the wall of the lamp vessel, each metal foil being connected to a respective external current conductor;

tungsten electrode rods each connected to a respective one of said metal foils and projecting from the wall of the lamp vessel into the discharge space; and an ionizable filling in the discharge space, characterized in that:

in the wall of the lamp vessel the electrode rods have a circumferential coating of quartz glass, at least adjacent the respective metal foil, which coating is mechanically unconnected with the quartz glass of the wall by a crack therebetween.

2. A high-pressure gas discharge lamp as claimed in claim 1, characterized in that the electrode rods comprise an additive, which additive is also present at least in a layer of the coating which adjoins the interface of the electrode rod and the coating.

3. A high-pressure gas discharge lamp as claimed in claim 1, characterized in that the additive comprises an element chosen from the group consisting of thorium, hafnium, chromium, aluminium, titanium, tantalum, magnesium, calcium, strontium, barium, zirconium, lanthanum, scandium, lanthanides, niobium, boron, and yttrium.

4. A high-pressure gas discharge lamp as claimed in claim 1, characterized in that the electrode rods comprise rhenium at their surface.

5. A high-pressure gas discharge lamp as claimed in claim 4, further comprising a lamp cap holding said lamp vessel.

6. A high-pressure gas discharge lamp as claimed in claim 5, further comprising a lamp cap holding said lamp vessel.

7. A high-pressure gas discharge lamp as claimed in claim 3, further comprising a lamp cap holding said lamp vessel.

8. A high-pressure gas discharge lamp as claimed in claim 2, further comprising a lamp cap holding said lamp vessel.

9. A high-pressure gas discharge lamp as claimed in claim 1, further comprising a lamp cap holding said lamp vessel.

10. A gas discharge lamp having a quartz glass discharge vessel enclosing a discharge space, a discharge sustaining filling within said discharge space, a pair of electrode rods extending into said discharge space, and a pair of current conductors each connected to a respective electrode rod and extending through said discharge vessel to the exterior thereof in a gas-tight manner, wherein the improvement comprises:

a said current-conductor includes a metal foil connected to a respective electrode rod; and means for increasing the heat capacity and the heat conductance of said respective electrode rod, said means including a generally cylindrical layer of said quartz glass fixed to said respective electrode rod and extending from said discharge space to said metal foil, said layer being defined by a generally cylindrical crack in said discharge vessel surrounding said electrode rod.

11. A high gas discharge lamp according to claim 10, wherein said electrode rods comprise tungsten.

12. A high-pressure gas discharge lamp, comprising:

a discharge vessel consisting of glass having an $SiO_2$ content of at least 98% by weight, said discharge vessel having a wall portion enclosing a discharge space, which wall portion about said discharge vessel is free of an exhaust tube tip-off, and a pair of opposing seals sealing the discharge vessel in a gas-tight manner;

a discharge-sustaining fill within said discharge space;

a pair of tungsten electrode rods each extending from a respective seal into the discharge space and between which a discharge is maintained during lamp operation;

a metal foil within each seal connected to a respective electrode rod; and an external conductor extending from each metal foil through the seal to the exterior thereof, each of said seals including an internal generally cylindrical crack surrounding its respective electrode rod extending from said discharge space out to its respective metal foil and which defines a generally cylindrical layer of said glass on each electrode rod which is mechanically disconnected from said seal by said crack, said layer being effective to increase the heat capacity and heat conductance of the electrode rod over that of the tungsten electrode rod alone, and said foil being sealed in said seal to seal said discharge space in a gas-tight manner.

13. A high-pressure gas discharge lamp as claimed in claim 12, characterized in that the electrode rods comprise an additive, which additive is also present at least in a layer of the coating which adjoins the interface of the electrode rod and the coating.

14. A high-pressure gas discharge lamp as claimed in claim 12, characterized in that the additive comprises an element chosen from the group consisting of thorium, hafnium, chromium, aluminum, titanium, tantalum, magnesium, calcium, strontium, barium, zirconium, lanthanum, scandium, lanthanides, niobium, boron, and yttrium.

15. A high-pressure gas discharge lamp as claimed in claim 12, characterized in that the electrode rods comprise rhenium at their surface.

16. A high-pressure discharge lamp as claimed in claim 12, wherein each of said generally cylindrical cracks has end portions at each end thereof which extend at an acute angle to the respective said electrode rod.

17. A high-pressure discharge lamp as claimed in claim 10, wherein said generally cylindrical crack includes an end portion at each end thereof which extends at an acute angle to said electrode rod.

18. A high-pressure discharge lamp as claimed in claim 1, wherein said generally cylindrical crack includes an end portion at each end thereof which extends at an acute angle to said electrode rod.

* * * * *